United States Patent [19]

Greco

[11] Patent Number: 4,470,806

[45] Date of Patent: Sep. 11, 1984

[54] REGENERATIVE INCINERATORS

[76] Inventor: Richard Greco, Box 115, Vernon, N.J. 07462

[21] Appl. No.: 422,590

[22] Filed: Sep. 24, 1982

[51] Int. Cl.[3] ..... F27D 17/00

[52] U.S. Cl. ..... 432/182; 110/304; 137/309; 165/101

[58] Field of Search ..... 110/302, 304; 165/12, 165/101; 137/309, 311; 432/180, 181, 182

[56] References Cited

U.S. PATENT DOCUMENTS

| | | | |
|---|---|---|---|
| 3,170,680 | 2/1965 | Keefer | 137/309 |
| 3,692,096 | 9/1972 | Pettersson et al. | 165/101 |
| 4,174,948 | 11/1979 | Bradley et al. | 432/182 |
| 4,358,268 | 11/1982 | Neville | 110/304 |

*Primary Examiner*—Edward G. Favors
*Assistant Examiner*—Steven E. Warner

[57] ABSTRACT

A regenerative incinerator comprising at least two vertical heat exchanger chambers each having horizontal grates in an intermediate region thereof, a combustion chamber above the heat exchanger chambers connected at its bottom side to the top side of the heat exchanger chambers and an inlet duct connected into a region below the grates of each of the heat exchange chambers. A first valve resides in each of the inlet ducts and an exhaust duct is connected to another region below the grate of each heat exchanger chamber. A second valve resides in each exhaust duct and a timing means is provided having alternating first and second cycles, the first cycle of the timing means opening a portion of the valves and closing the second valves of the heat exchanger chambers having open first valves and opening a second valve of another heat exchanger chamber having a closed first valve and the second cycle of the timing means closing the first valve and opening the second valve of the heat exchanger chambers.

5 Claims, 6 Drawing Figures

REGENERATIVE INCINERATORS

This invention is directed to incinerators and in particular to improved anti-pollution regenerative incinerators.

In the prior art, as exemplified by U.S. Pat. No. 3,895,918, anti-pollution regenerative incinerators use two spaced vertical porous walls to retain ceramic pellets in thermal exchange chambers. One of such vertical walls is a louvered retainer facing the hot combustion chamber and the other vertical wall is a mesh or screen facing the cooler portion of the chamber. Under average operating conditions, the hot side louver can be exposed to a temperature of up to about 1500° F. to avoid a short life failure maintenance problem. In such prior art device, the hot wall presents a detrimental friction loss as the moving gases pass through the louvers.

An object of this invention is to increase the service life and reduce the maintenance expense of the retainers for a bed of ceramic pellets in a combustion chamber.

Another object of this invention is to increase the temperature in the combustion chamber without increasing the maintenance expense for the retainers of the ceramic thermal bed in an improved anti-pollution regenerative incinerator.

Another object is to reduce the friction loss of the gas passing through hot retainers for thermal ceramic beds.

Still another object of this invention is to decrease the size of the combustion chamber for a selected pollution destruction.

In accordance with this invention, a single horizontal grate replaces two vertical retainers of the prior art. The top side of the ceramic pellet horizontal bed is exposed to the hot furnace temperatures without a retainer. The lower single grid retainer supports the ceramic pellet bed and faces the cool temperature portion of the incinerator.

Accordingly, the maintenance of retainers for the ceramic pellet horizontal bed is substantially reduced. With the absence of a retainer facing the hot combustion chamber, the temperature of the horizontal hot face of the ceramic pellet bed can be practically raised from 1500° F. to 2200° F. without increasing retainer maintenance expense and with resulting increase in pollution destruction efficiency and reduction in size of the combustion chamber for a selected amount of pollution destruction.

The invention will be more fully understood by reference to the following detailed description which is accompanied by drawings in which.

Figure 1:
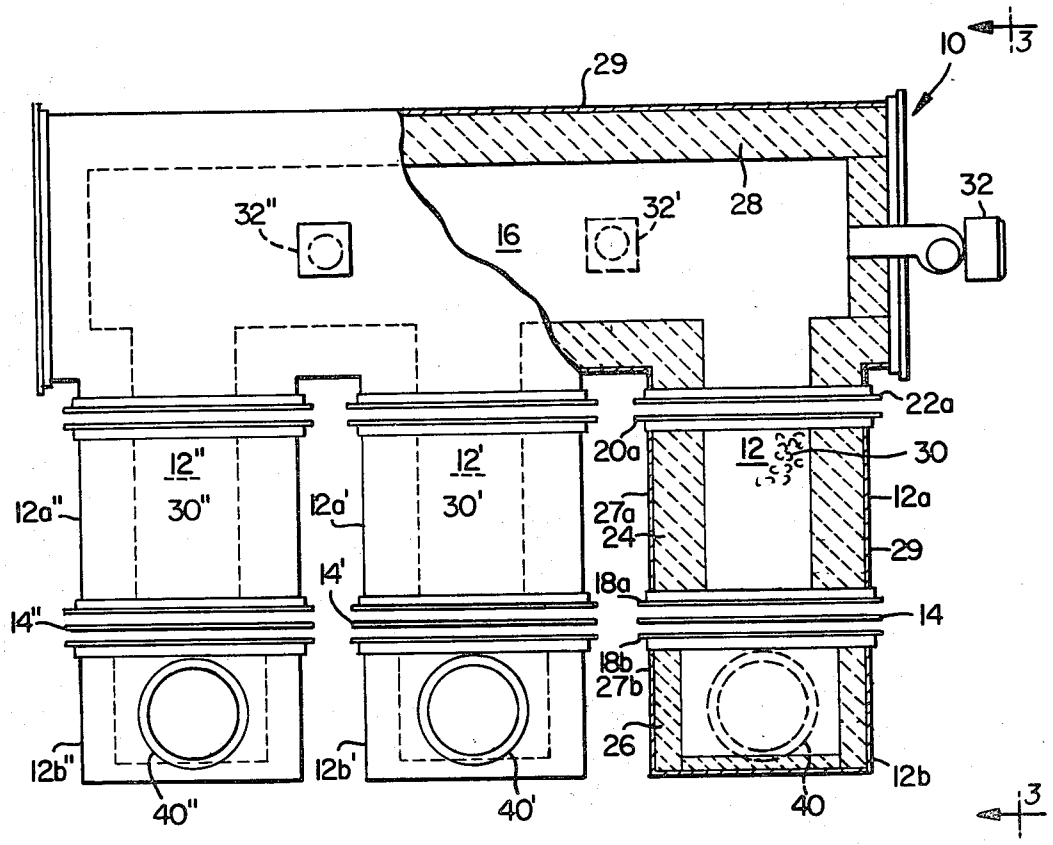
FIG. 1 is an elevation view, partly in cross section of an anti-pollution incinerator according to the invention.
Figure 2:
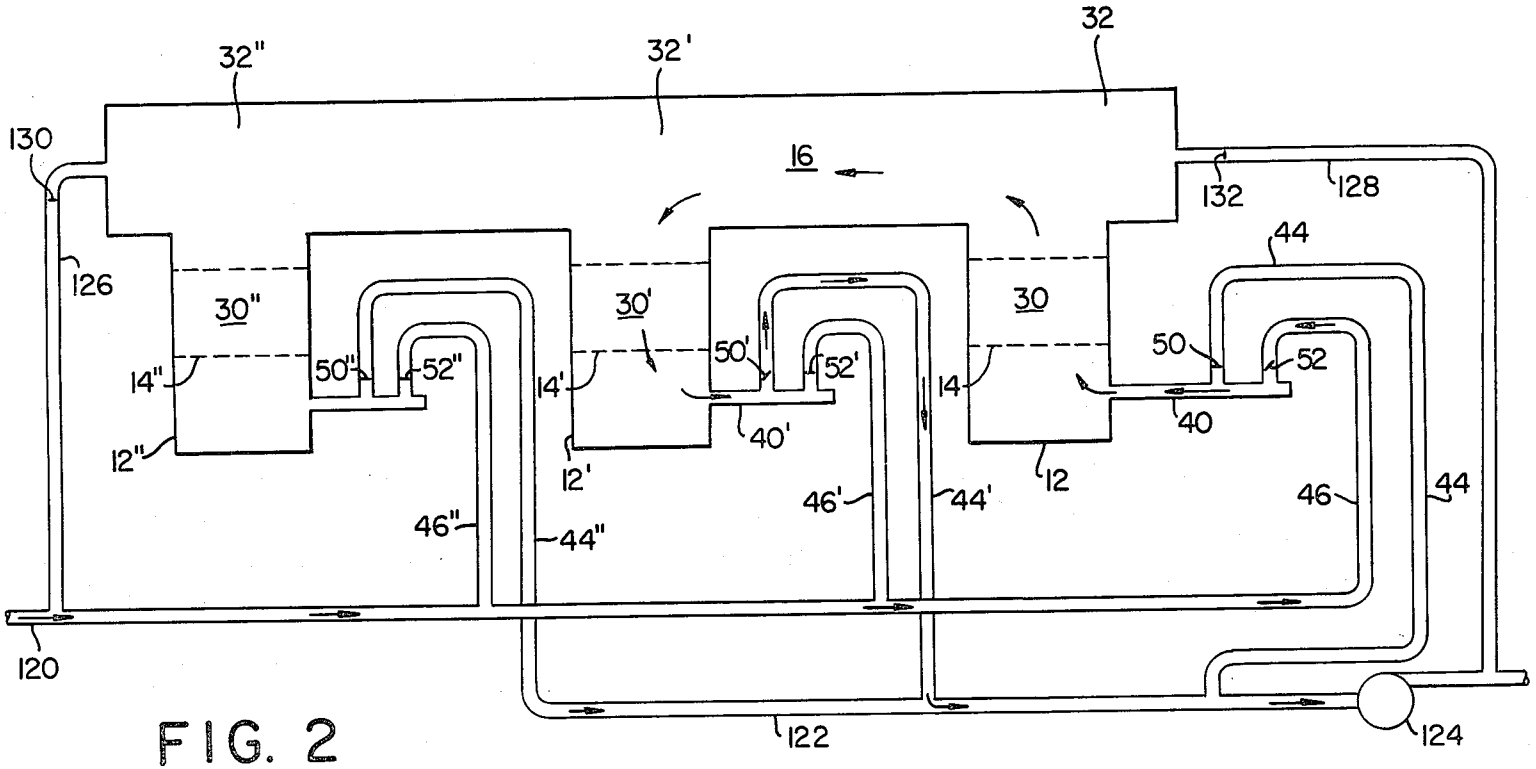
FIG. 2 is a schematic diagram of the incinerator of FIG. 1.

In FIGS. 1 and 2, an anti-pollution regenerative incinerator 10 comprises at least two vertical heat exchanger chambers 12, 12', and preferably at least one more vertical heat exchanger chamber 12'', each having a horizontal grate 14, 14', 14'' in an intermediate portion of its associated heat exchanger and a horizontal combustion chamber 16 connected at its bottom side to each of the top sides of heat exchanger chambers 12, 12', 12''. Preferably, each vertical heat exchanger chamber has a top section **12*a*, 12*a'*, 12*a''* and a lower bottom section 12*b*, 12*b'*, 12*b''* with flanges 18*a*, 18*b* to secure grate 14 therebetween with bolts ands nuts (not shown) in a conventional manner, so as to facilitate maintenance and repairs of heat exchanger chamber 12. The top portion of heat exchanger 12*a* has a flange 20*a* to be bolted up in a conventional manner to a mating flange 22*a* residing at the opening of combustion chamber 16 to heat exchanger chamber 12. Insulation 24, 26, 28 protects the steel shell 27*a* of heat exchange chamber 12*a*, steel shell 27*b* of heat exchange chamber 12*b*, and steel shell 29 of combustion chamber 16**, respectively.

The interiors of the reaction chambers are preferably lined with FIBERFRAX as manufactured by Carborundum Co. and of sufficient thickness to limit the temperature of all exterior shells to under 175 degrees F. when the interior of regenerative incinerator has reached 2000 degrees F. The exterior shells are preferably manufactured of steel plate of no less than 3/16" in thickness. Stacked upon grids 14, 14', 14'' are beds 30, 30', 30'' of selected depth of ceramic or metallic elements or pellets as commercially available under the trade name BERL SADDLES and as manufactured by Mauris Knight & Co. Such ceramic elements 30 are preferably of the type and configuration used commercially in packed absorber towers and capable of withstanding a temperature of 2400 degrees F.

The grids 14, 14', 14'' are preferably fabricated of perforated plate, mesh or bar grating of sufficient strength at the interior temperature of the lower chamber **12*b* to support the weight of the ceramic elements 30, 30', 30'' located thereabove. Very significantly, the high temperature in the combustion chamber 16 and the interior of the upper section 12*a* is shielded from grids 14, 14', 14'' by the beds 30, 30', 30''. Typically the temperature at the upper surface of bed 30 is between 1400 degrees F. and 2200 degrees F. while the temperature at the grids 14, 14', 14''** is between 70 degrees F. and 1000 degrees F. Such low temperature at the grids permit long grid life and low maintenance costs.

Burners 32, 32', 32'' are normally used to raise the temperature in the combustion chamber. The amount of heat energy to be entered into the combustion chamber and the temperature thereof depends upon the combustibles present in the contaminated air and/or gases to be inputed in the regenerative incinerator 10.

The burners 32, 32', 32'' can be the industrial power or induced draft type depending on whether the pressure in the combustion chamber 16 is above or below atmospheric pressure.

The combustion chamber 16 preferably should have a volume to retain the gases passing therethrough for two seconds at about 2000 degrees F. Typical combustion chamber temperatures are 1400 degrees F. to 2200 degrees F. as determined by the difficulty of destruction of the noxious fumes.

Figure 3:
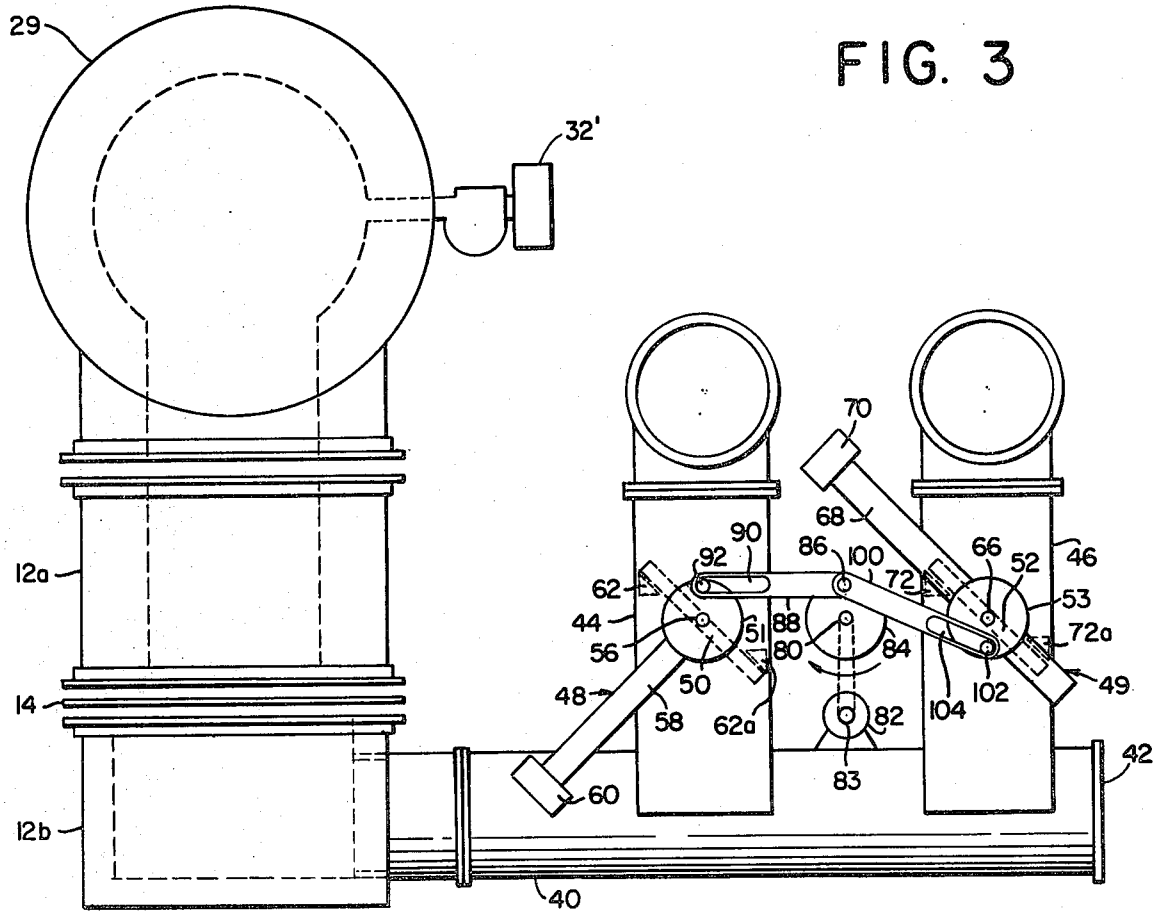
FIG. 3 is a cross sectional view 3—3' of FIG. 1 showing inlet and outlet flap valves and the timing means therefor, according to the invention.

Each of the heat exchanger chambers 12, 12', 12'' has equipment shown in FIG. 3 which will hereinunder be described for chamber 12.

One side of a horizontal duct 40 is connected to the interior of the lower section 12*b* below the grate 14, the other end of duct 40 being closed off by a plate 42. Tapped into duct 40 is a vertical outlet duct 44 and a vertical inlet duct 46.

As shown in FIG. 3, flap valves 48, 49 (otherwise known as pivoted disk valves) each have a flap disk 50, 52 installed in ducts 44, 46, respectively. Flap valve 48 has its disk 50 fixed to a journaled horizontal shaft 56. Fixed to pin 56 and at a right angle to disk 50 is a downwardly extending arm 58 with a hub 51 at one end and a weight 60 at the other end thereof to maintain duct 44 closed by gravity acting upon weight 60 to urge disk 50 counterclockwise against its tops 62, 62*a*.

Flap valve 49 has its flap disk 52 fixed to a rotatable horizontal shaft 66. Attached in line with the plane of disk 52 is an upwardly extending arm 68. Flap valve 49 also has a hub portion 53 with a weight 70 at the end thereof to maintain duct 46 closed by gravity acting on the weight 70 to urge disk 52 counterclockwise against its stops 72, 72*a*.

Valves 50 and 52 open and close as controlled by a shaft 80 rotated in a conventional manner by a variable speed motor 82 having a single shaft 83 which is common to and drives all pivoted disk valves, hereinafter referred to as flop valves; namely, 48, 49 and similar flop valves for chambers 12' and 12''. Attached to shaft 83 is a conventional transmission which rotates hub 84 upon shaft 80. Fixed to hub 84 is an offset pin 86. One end of a crank 88 is rotatably journaled upon the offset pin 86 and the other end has a slot 90 slidably engaged to an offset pin 92 fixed to the hub 51. One end of another crank 100 is rotatably journaled upon the pin 86 and the other end has a slot 104 which is slidably engaged to an offset pin 102 as fixed to hub 53.

Figure 4:
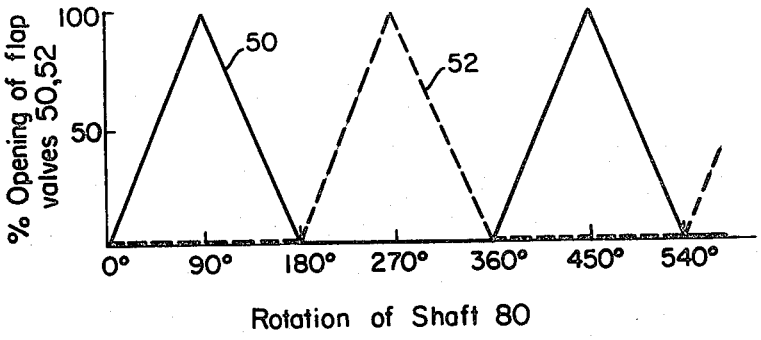
FIG. 4 is a diagram showing the operations of inlet and outlet flap valves of one heat exchange chamber of FIG. 2.

The linkage mechanism of FIG. 3 is engineered to operate the outlet and inlet flap valves 50 and 52 as shown in FIG. 4. When the shaft 80 is at zero degrees, both valves 50, 52 are closed. Above zero degrees, outlet flap valve 50 begins and continues to open and at 90 degrees is fully open. After 90 degrees, outlet flap valve 50 begins and continues to close until it is fully closed at 180 degrees. During the interval zero to 180 degrees, inlet flap valve 52 remains closed. Above 180 degrees, inlet flap valve 52 begins and continues to open and at 270 degrees is fully open. After 270 degrees, inlet flap valve 52 begins and continues to close until it is fully closed at 360 degrees. During the interval 180 to 360 degrees, outlet flap valve 50 remains closed. The cycle then repeats and the amount of time that flap valves 50, 52 remain open is governed by the speed of motor 82. Vertical heat exchanger chambers 12' and 12'' have components and construction similar to that described for chamber 12 and each is connected at its top side with openings at the bottom side of combustion chamber 16.

As shown in the schematic diagram of FIG. 2, all the inlet ducts 46, 46', 46'' are connected as branches to a common inlet duct 120 and all the outlet ducts 44, 44', 46'' are connected as branches to a common outlet duct 122. An exhaust blower 124 is connected to the end of outlet duct 122 and inlet duct 120 is connected to a source of obnoxious and polluted gas having combustibles.

Shaft 80 and variable speed motor 82 are common to all reaction chambers 12, 12', 12''. When only two vertical heat exchange chambers 12, 12' are employed, the linkages for flap valves 50 and 50' are phase displaced by 180 degrees. When three vertical heat exchanger chambers are employed, the linkages for flap valves 50, 50' and 50'' are phase displaced by 120 degrees. All linkages are designed so that the gas flow through the incinerator 10 is not interrupted regardless of the positions of all the flap valves and that no two flap valves associated with any one heat exchange chamber are open at the same instant.

Figure 4A:
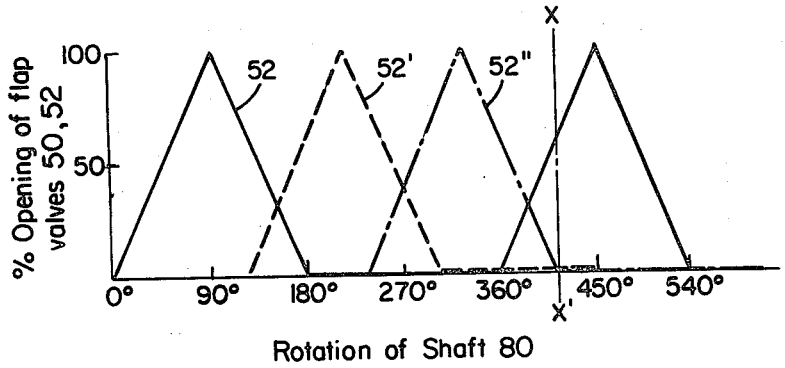
FIG. 4A is a diagram showing the operations of the inlet flap valves of the three heat exchange chambers of FIG. 2.
Figure 4B:
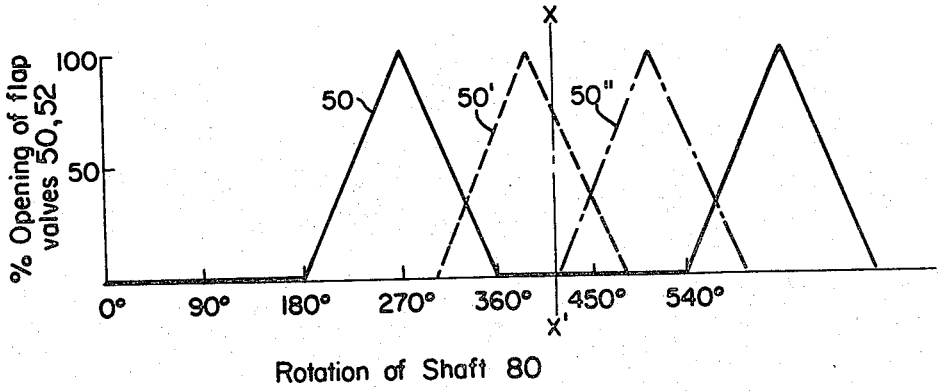
FIG. 4B is a diagram showing the operation of the outlet flap valves of the three heat exchange chamber of FIG. 2.

The operation of the inventive anti-pollution incinerator 10 will now be explained with reference to FIGS. 2, 4, 4A and 4B. Noxious polluted gases are drawn into inlet duct 120 by the blower 124. The heat absorption and heat release alternate cycles of the three heat exchange chambers 12, 12' and 12'' are illustrated in FIGS. 4A and 4B. The position of all flap valves will be considered at 420 degree displacement of shaft 80. Inlet flap valve 52'' is closed and the inlet gas enters duct 46 and then into duct 40 through flap valve 52 which is opening and is approximately two-thirds open, see FIG. 4A. In a heat energy release relationship, the polluted gas then is preheated by the ceramic element bed 30 which has been formerly heated in a prior cycle when flap valve 50 was open.

The combustibles in the polluted preheated gas are then burned off in the combustion chamber 16 which has been elevated to a high temperature by burners 32, 32', 32''. The clean hot gas then passes through ceramic bed 30' which has given up its heat energy in a prior cycle when flap valve 52' was open, valve 50' was closed and cold inlet air passed upwardly in duct 46' and then through hot bed 30' until it was cooled. Accordingly, a heat exchange is accomplished so that the hot clean gas is cooled and the cold ceramic heat retentive bed 30' is heated for the next cycle when cold polluted inlet air moves upward over the hot bed 30'. The clean cooled gas then leaves ducts 40', through flap valve 52 which is closing and is approximately still two-thirds open, see FIG. 4B. Thereafter, the cooled unpolluted gas passes through the outlet duct 122 by the draft of blower 124. During the described shaft 80 displacement instant at 240 degrees as shown by X—X' on FIGS. 4A and 4B, flap valves 50'' and 52'' are closed so that heat regenerative chamber 12'' is inactive. But at 241 degrees, exhaust flap valve 50'' begins to open.

Also shown in FIG. 2 an inlet bypass duct 126 is connected from inlet duct 120 to combustion chamber 16 and an outlet bypass duct 128 is connected from combustion chamber 16 to a venturi connected to the discharge side of blower 124. Bypass valves 130, 132 are installed in the inlet and outlet bypass ducts 126, 128, respectively, to selectively or automatically operate a bypass safety routine as now described when a predetermined unsafe temperature is reached in the combustion chamber 16.

In the event that fumes contain hydrocarbons of sufficient heat energy to elevate temperature beyond a safe operating limit, the bypass ducts and associated valves will divert such high heat content gases to avoid the reaction chambers by channeling such fumes directly to one end of the combustion chamber. The gases will then leave out the other end thereof with sufficient dwell time to burn off or convert the hydrocarbons to $CO_2$+-$H_2O$.

The number of heat exchange chambers to be employed is governed by the space limitations and gas flow volumes. Larger flows require larger ducts and larger valves. When increasing such items becomes abnormally expensive, it may be more economical to install one or more additional heat exchange chambers. If three more heat exchange chambers are added to FIG. 1 in spaced relationship, the linkages of the six flap valves 50, 50′, 50″, 50‴, 50⁗, 50′⁗ are then adjusted to be 60 degrees phase displaced relative to each other. Or, the three additional reactive chambers can be added in parallel to the three heat exchange chambers 12, 12′ and 12″ to handle twice the fume flow while maintaining the 120 degree phase displacement of the flap valve linkages as described hereinabove for the three heat exchange chambers 12, 12′ and 12″ of FIGS. 1 and 2.

While there has been described and pointed out the fundamental novel features of the invention as applied to a limited number of embodiments, it will be understood that various omissions and substitutes and changes in the form and details of the device illustrated and its operation may be made by those skilled in the art, without departing from the spirit of the invention. It is the intention, therefore, to be limited only as indicated by the scope of the following claims.

What I claim is:

1. An anti-pollution regenerative incinerator comprising at least three vertical heat exchanger chambers each having horizontal grates in an intermediate region thereof, a combustion chamber above said heat exchanger chambers connected at its bottom side to the top side of said heat exchanger chambers, a duct connected into a region below said grates of each of said heat exchange chambers, said duct having first and second branches, a plurality of first valves, one of said first valve residing in each of said first branches, a plurality of second valves, one of said second valves residing in each of said second branches and a timing means having alternating first and second cycles, said first cycle of said timing means selectively opening a portion of said first valves and closing the said second valves of the heat exchanger chambers which have open first valves and selectively opening a second valve of another heat exchanger chamber which has a closed first valve, so that the flow of gases through said incinerator remains uninterrupted and unidirectional.

2. An incinerator according to claim 1 wherein said timing means includes means to prevent said first valve and said second valve of any one heat exchanger chamber being both open at the same instant of time.

3. An incinerator according to claim 1 including a horizontal bed of heat retentive elements disposed upon said horizontal grates.

4. An incincerator according to claim 3 including an inlet duct connected to a plurality of said first branches and an outlet duct connected to a plurality of said second branches.

5. An anti-pollution regenerative incinerator comprising at least three vertical heat exchanger chambers each having horizontal grates in an intermediate region thereof, a combustion chamber above said heat exchanger chambers connected at its bottom side to the top side of said heat exchanger chambers, a duct connected into a region below said grates of each of said heat exchange chambers, said duct having first and second branches, a plurality of first valves, one of said first valves residing in each of said first branches, a plurality of second valves, one of said second valves residing in each of said second branches and a timing means having alternating first and second cycles, said first cycle of said timing means selectively opening a portion of said first valves and closing the said second valves of the heat exchanger chambers which has open first valves and selectively opening a second valve of another heat exchanger chamber which has a closed first valve, so that the flow of gases through said incinerator remains uninterrupted and unidirectional wherein said timing means includes a rotatable shaft, a first crank for each heat exchange chamber connected to said rotatable shaft, a second and third crank each having a slot and each jointly and rotatably connected to said first crank, said first and second valves each having a disk rotatable about its axis and having means to bias it into a closed position, the said disks of said first and second valves having a pin offset with respect to its axis of rotation and slidably engagable with one slot in said second and third cranks.

* * * * *